US006685337B2

(12) United States Patent
Klees

(10) Patent No.: US 6,685,337 B2
(45) Date of Patent: Feb. 3, 2004

(54) COMBINATION FLASHLIGHT AND CANDLE LANTERN

(76) Inventor: Garry W. Klees, 7515 SE. 76th St., Mercer Island, WA (US) 98040

( * ) Notice: Subject to any disclaimer, the term of this patent is extended or adjusted under 35 U.S.C. 154(b) by 0 days.

(21) Appl. No.: 10/176,630

(22) Filed: Jun. 21, 2002

(65) Prior Publication Data

US 2002/0196622 A1 Dec. 26, 2002

Related U.S. Application Data

(60) Provisional application No. 60/300,553, filed on Jun. 22, 2001.

(51) Int. Cl.[7] ..... F21S 19/00

(52) U.S. Cl. ..... 362/228; 362/161; 362/205; 362/208

(58) Field of Search ..... 362/202–208, 362/228, 229, 161, 172, 181, 392

(56) References Cited

U.S. PATENT DOCUMENTS

| | | | | | |
|---|---|---|---|---|---|
| 3,749,904 | A | * | 7/1973 | Graff | 362/265 |
| 3,774,023 | A | | 11/1973 | Cobarg et al. | 240/10.6 |
| 3,890,085 | A | | 6/1975 | Andeweg | 431/125 |
| 3,906,216 | A | | 9/1975 | Eriksson | 240/6.4 |
| 3,947,676 | A | | 3/1976 | Battilana et al. | 240/6.4 |
| 3,983,384 | A | * | 9/1976 | Bucci | 362/229 |
| 4,268,894 | A | | 5/1981 | Bartunek et al. | 362/158 |
| 4,286,310 | A | | 8/1981 | Brainkel et al. | 362/203 |
| 4,428,034 | A | | 1/1984 | Seller | 362/186 |
| 4,520,431 | A | * | 5/1985 | Fanelli et al. | 362/181 |
| 4,566,055 | A | | 1/1986 | Klees et al. | 362/162 |
| 4,800,469 | A | | 1/1989 | Leon | 362/72 |
| 5,158,356 | A | | 10/1992 | Guthrie | 362/188 |
| 5,386,351 | A | | 1/1995 | Tabor | 362/201 |
| 5,688,040 | A | | 11/1997 | Klees | 362/163 |
| 5,893,631 | A | | 4/1999 | Padden | 362/201 |
| 6,241,362 | B1 | * | 6/2001 | Morrison | 362/392 |
| 6,267,584 | B1 | * | 7/2001 | Zou | 362/228 |

* cited by examiner

*Primary Examiner*—Alan Cariaso
(74) *Attorney, Agent, or Firm*—Dean A. Craine

(57) ABSTRACT

A combination flashlight/candle lantern with a modified lower base designed to be used with the standard, metallic cover on a candle lantern. The modified lower base has an upper neck designed to selectively attach to the metallic cover. The modified lower base also includes an upward extending cavity and a transversely aligned candle platform designed to receive a tube candle. Formed on the opposite side of the candle platform is a downward extending lower cavity designed to receive a low profile flashlight assembly. The flashlight assembly includes a cylindrical-shaped housing designed to partially extend into the lower base. Located centrally on the housing is a longitudinally extending LED electrically connected to two side-by-side watch batteries. Attached over the lower opening on the housing is a combination lens/switch which, when rotated, controls operation of the LED. The flashlight assembly may also include a bail located on the base member opposite the combination lens/switch. The bail may be disposed in a concealed manner when the flashlight assembly is attached to the lower base, or may allow the separated flashlight assembly to be independently supported from a hook or aimed on a flat surface.

17 Claims, 5 Drawing Sheets

COMBINATION FLASHLIGHT AND CANDLE LANTERN

This is a utility patent application based on the provisional patent application (Ser. No. 60/300,553) filed on Jun. 22, 2001.

BACKGROUND OF THE INVENTION

1. Field of the Invention

This invention pertains to candle lanterns, and, more particularly, to candle lanterns with flashlight components.

2. Description of the Related Art

Battery-powered flashlights and lanterns have been used for many years for general-purpose recreational lighting. Because of the difficulty in determining the amount of time a set of batteries will continue producing energy, extra batteries are usually carried by the user. Also, because of the batteries' relatively short life, they must be used with discretion. Unfortunately, the batteries gradually lose their charge when not used. Therefore, most users remove them from their backpacks when the backpacks are placed in storage. Another problem is that their switches can inadvertently be turned-on when carried in a backpack thus causing the batteries to be completely discharged.

Candle lanterns, such as those disclosed in U.S. Pat. Nos. 4,566,055 and 5,688,040 are very popular with all types of recreational users. Candle lanterns are normally preferred over gas or electric powered lanterns because gas or electric lanterns give off too much light in enclosed spaces such as inside a tent, and last only for a couple of hours. Candle lanterns provide lower illumination, which adds ambience to any occasion, for up to eight hours. Another feature of the candle lanterns described in the above-referenced patents is that remaining candle life is readily visible through view slots formed on the sides of the candle lantern.

One drawback with candle lanterns, however, is that they can be difficult to light in the dark and in windy conditions. When the candle flame is accidentally blown out, the user must find matches in the dark to re-light the candle. If the user is outdoors, he or she must often "cup" his or her hands to block the wind. In order to ignite the wick, the candle is often tilted to one side which causes a small amount of hot liquid wax to accumulate on the top of the candle and spill onto the user.

A combination candle lantern and flashlight is needed that is lightweight and compact for backpacking. Such a device should enable the flashlight component to be easily disconnected from the candle lantern body so that both components may be independently used. Such a device should use a low electrical power-demanding lamp, and include a switch mechanism that is less susceptible to being inadvertently activated.

SUMMARY OF THE INVENTION

It is an object of the present invention to provide a combination flashlight and candle lantern.

It is another object of the present invention to provide a device that is lightweight, compact, and allows the flashlight assembly to be detached from the candle lantern body so that each component may be independently used.

It is another object of the present invention to provide such a flashlight assembly that uses a low-power LED for illumination and a switching means designed to prevent inadvertent activation.

It is a further object of the present invention to provide such a device that uses a modified lower base that may be used with the upper metal cover and candle holding assembly in existing candle lanterns.

These and other objects of the invention which will become apparent are met by a combination flashlight/candle lantern which is similar to the candle lantern assembly disclosed in U.S. Pat. No. 4,566,055 and incorporated by reference herein. Such candle lanterns, shown in FIGS. 1 and 2, and generally referenced is 5, include an upper, cylindrical-shaped metal cover 6 that selectively attaches to a cylindrical-shaped lower base 7. A telescopingly adjustable glass lens 8 moves inside the metal cover 6. Formed inside the lower base 7 is an upward extending cavity (not shown) with a candle holding assembly 9 located therein that removably holds an elongated candle 10 in an upright, perpendicularly aligned position over the lower base 7. Slots (not shown) formed on the external surface of the lower base 7 engage detents (not shown) formed on the inside surface of the metal cover 6 to selectively connect the metal cover 6 to the lower base 7.

The combination flashlight/candle lantern disclosed herein uses a modified lower base designed to be used in place of the lower base 7. The modified lower base, which connects to the metal cover 6, lens 8, and candle holding assembly 9, all used in the prior art, is also cylindrical-shaped, with an outer diameter identical to the lower base 7. Also formed inside the modified lower base is an upper cavity designed to receive the candle holding assembly 9 that holds an elongated candle 10 in an upright, perpendicularly aligned position.

A key difference between the modified lower base and the lower base 7 used in the prior art is the downward extending lower cavity formed on the modified lower base. The lower cavity is designed to selectively receive a low profile, battery-powered flashlight assembly. The flashlight assembly may be selectively attached and removed from the modified lower base so that the flashlight assembly and candle lantern may be used independently. The flashlight assembly is designed to have a relatively low profile so that the overall length of the combination flashlight/candle lantern is nearly identical to candle lanterns found in the prior art. It includes a cylindrical-shaped base member, a combination lens-switch component, at least one flat battery, a longitudinally aligned, low power illumination means, and a set of electrical contacts. A means for locking is also provided on the modified lower base and the base member that selectively holds the base member inside the lower cavity. The combination lens-switch component is designed to be manually rotated to activate and de-activate the illumination means located in the flashlight assembly thereby preventing inadvertent activation when stored. The flashlight assembly also includes an optional bail that enables the flashlight assembly, when removed from the base member, to be separately carried by the user or attached to a hook.

DESCRIPTION OF THE PREFERRED EMBODIMENT(S)

Figure 3:
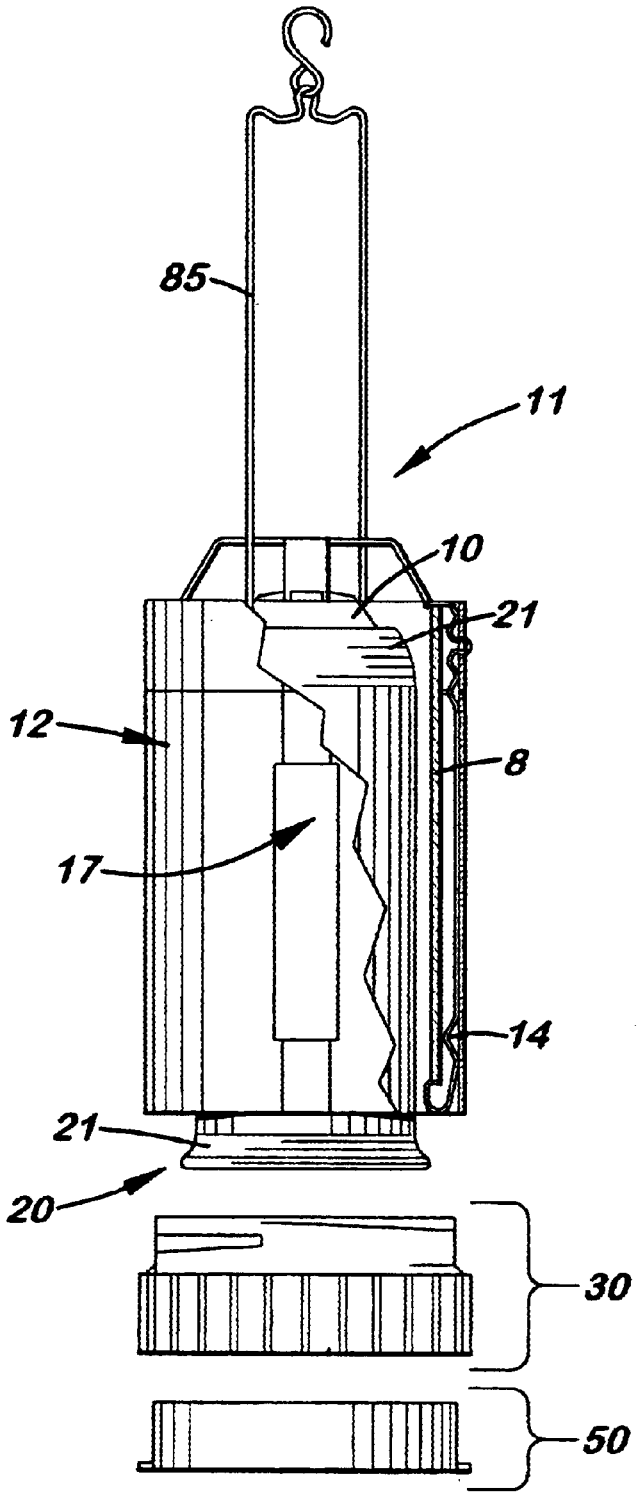
FIG. 3 is a front elevation view of the combination flashlight/candle lantern disclosed herein.
Figure 4:
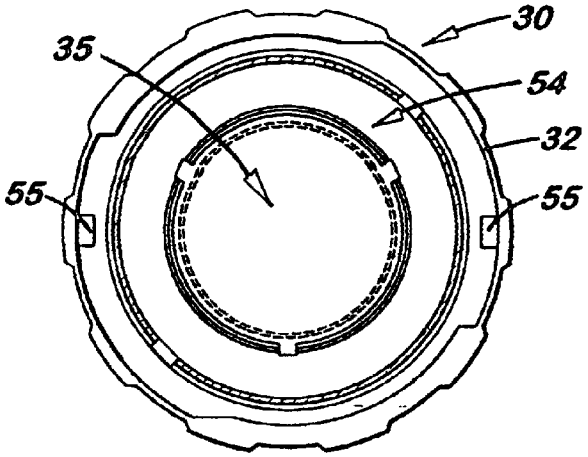
FIG. 4 is a top plan view of modified lower base.
Figure 5:
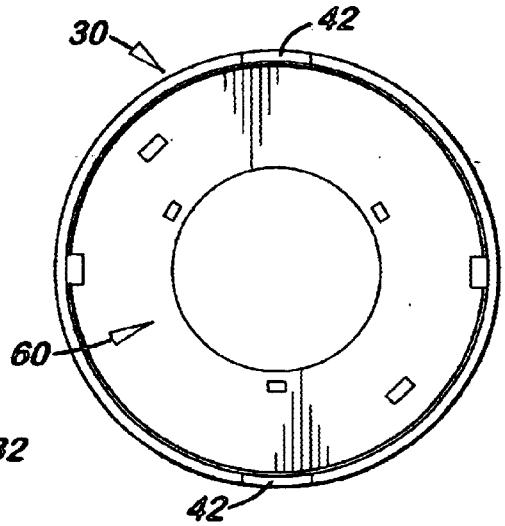
FIG. 5 is a bottom plan view of the modified lower base.
Figure 6:
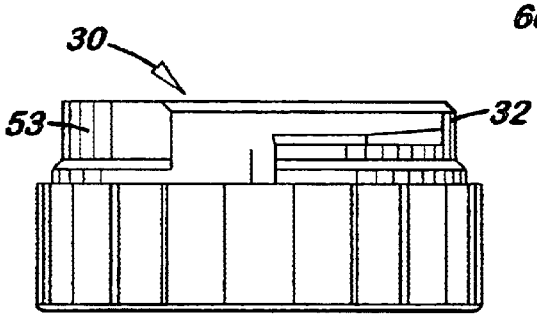
FIG. 6 is a front elevation view of the modified lower base.
Figure 7:
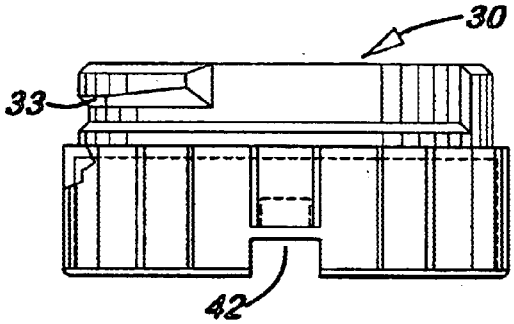
FIG. 7 is a side elevation view of the modified lower base.

Referring to the accompanying FIG. 3, there is shown and described a combination flashlight/candle lantern 11 composed of the upper metal cover 12, a modified lower base 30, a candle holding assembly 51, an elongated candle 10 and a cylindrical lens 8. The modified lower base 30, shown more clearly in FIGS. 4–7, is cylindrical-shaped with upward extending outer sidewall 32 that include grooves 33 formed on its outer surface that connect to detents 14 formed near the lower edge of the upper cover 12. Formed inside the modified lower base 30 is a candle receiving upper cavity 35 designed to connect to a candle holding assembly 51 that holds an elongated candle 10 in an upright, perpendicularly aligned position.

Figure 1:
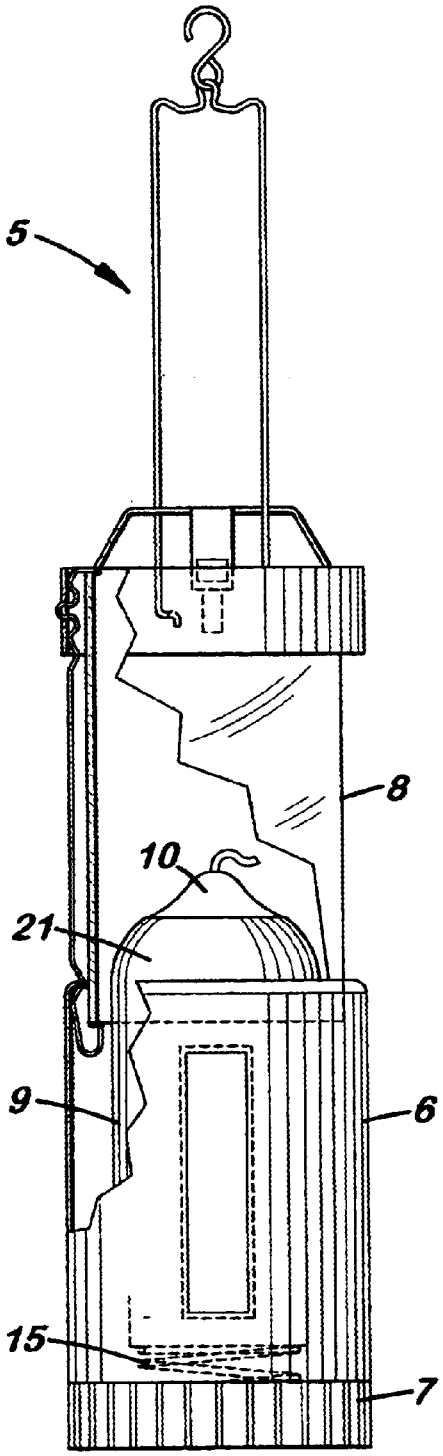
FIG. 1 (PRIOR ART)
FIGS. 1 and 2 show a candle lantern found in the prior art.
Figure 2:
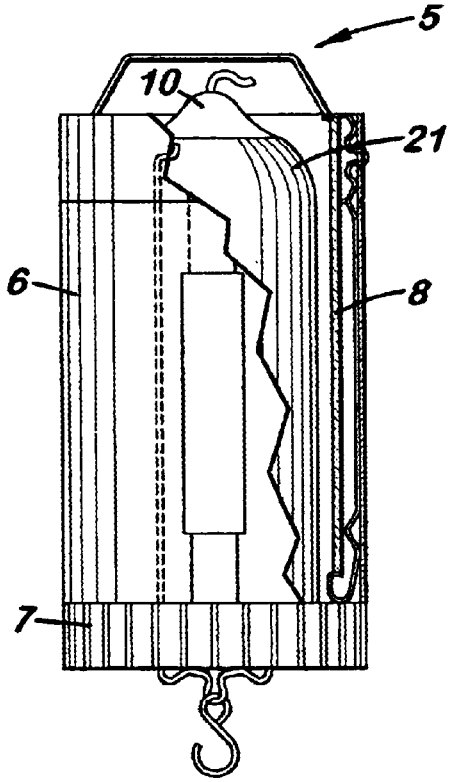
FIG. 2 (PRIOR ART)
Figure 8:
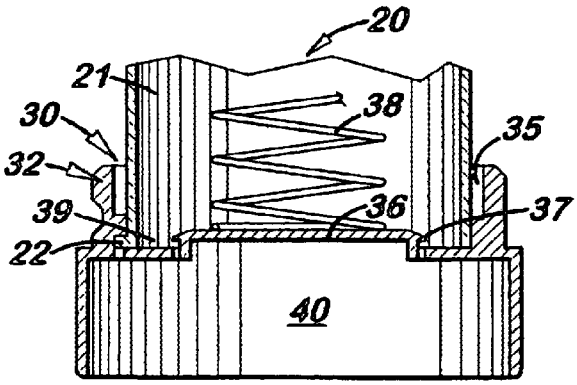
FIG. 8 is a sectional, front elevation view of the modified lower base.

The candle holding assembly 20 includes a candle tube 21 selectively mounted on a candle platform 36 formed inside the modified lower base 30. Disposed inside the candle tube 21 is a longitudinally aligned spring similar to the spring 15 used in the candle lantern 5 found in the prior art and shown in FIG. 1. The spring forces the un-burned portion of the candle 20 upward inside the candle tube 21. The candle platform 36 is centrally located and cylindrical-shaped with a raised outward extending edge 37 designed to engage the lower edge of the spring 15 perpendicularly aligned over the platform 36 as shown in FIG. 8. Formed on the inside surface of the outer sidewall 32 is a circular groove 39 designed to engage the outer extending edge 22 of the candle tube 21 to hold the candle tube 21 in place inside the upper cavity 35.

Formed on the lower portion of the modified lower base 30 opposite the upper cavity 35 is a downward extending lower cavity 40. Formed on the outside sides of the lower edge of the modified lower base 30 are slots 42 that receive arms 56, 57 formed on the flashlight assembly. In the preferred embodiment, the modified lower base 30 measures approximately 2 inches in diameter and approximately 1 inch in height. The upper and lower cavities 35, 40 respectively, are both approximately 1.94 inches in diameter and approximately 0.75 and 0.56 inch, respectively, in height. The height of the lower cavity 40 must be sufficient to receive the flashlight assembly 50 so that the candle lantern to be stored or used in an upright orientation on a flat surface.

Figure 9:
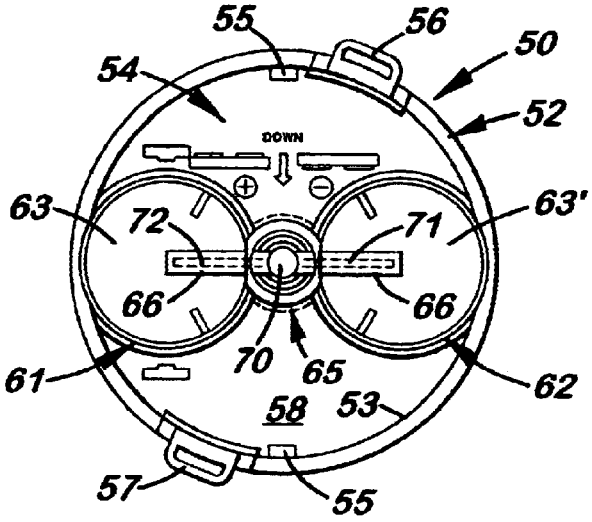
FIG. 9 is a top plan view of the flashlight assembly base member.
Figure 10:
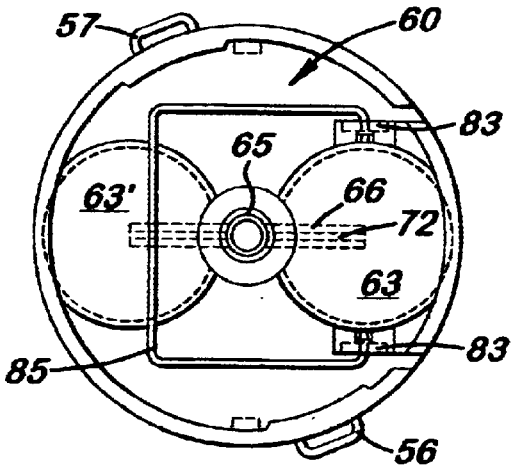
FIG. 10 is a bottom plan view of the flashlight assembly base member.
Figure 11:
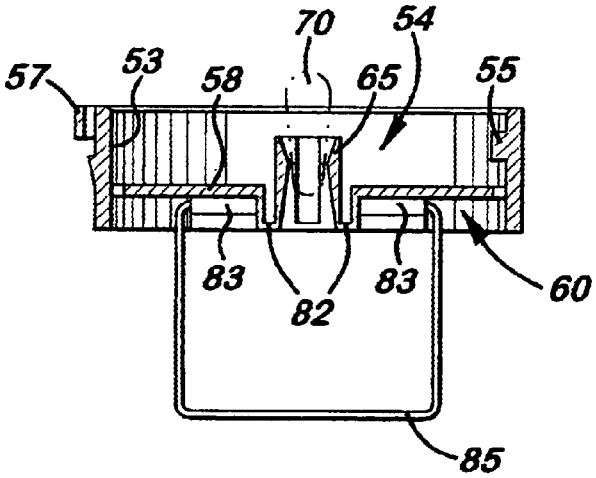
FIG. 11 is a sectional, side elevational view of the flashlight assembly base member.
Figure 12:
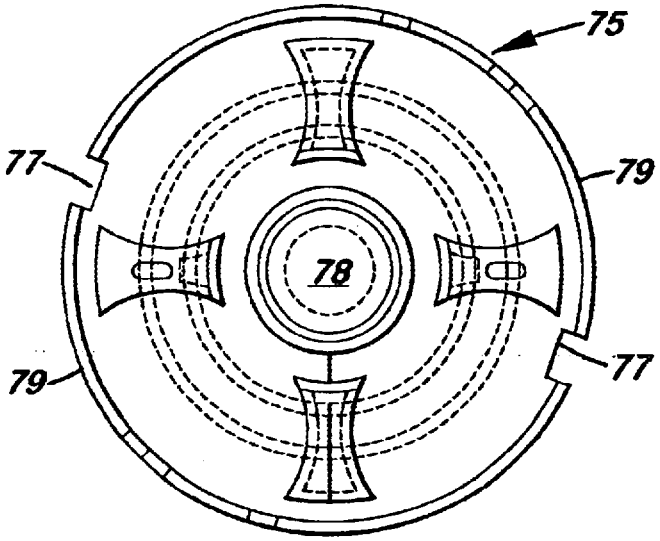
FIG. 12 is a top plan view of the lens.
Figure 13:
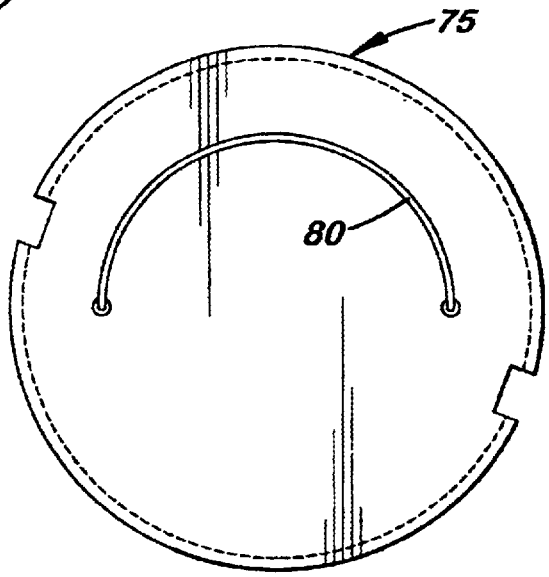
FIG. 13 is a bottom plan view of the lens.
Figure 14:
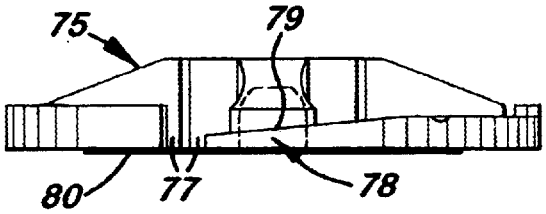
FIG. 14 is a side elevational view of the lens.
Figure 15:
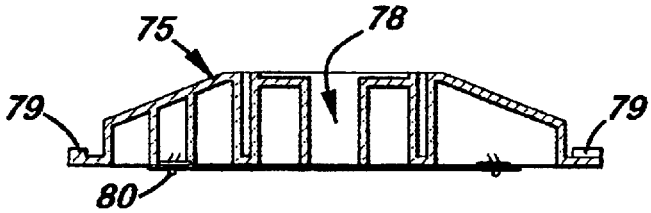
FIG. 15 is a sectional, side elevational view of the lens.

As stated above, the flashlight assembly 50 is a low profile structure designed to fit completely into the lower cavity 40. The flashlight assembly 50, shown more clearly in FIGS. 9–11, includes a cylindrical-shaped base member 52 with a transverse member 58 and an outer sidewall 53. Formed inside the base member 52 is an upward extending first cavity 54. Formed on opposite sides of the sidewall 53 are two longitudinally aligned compression arms 56, 57 that extend into complementary-shaped recessed slots 42 formed on the sidewall 53 of the modified lower base 30. During assembly, the compression arms 56, 57 snap-fit into the slots 42 to selectively hold the base member 52 inside the lower cavity 40.

The transverse member 58 that divides the base member 52 into first and second cavities 54, 60 respectively. Formed on the transverse member 58 are two circular battery receiving recessed spaces 61, 62, each designed to receive a low-profile watch battery 63, 63'. The recessed spaces 61, 62 face the first cavity 54 and have sufficient depth so that the top surfaces of the batteries 63, 63' extend slightly above the inside of the surface of the transverse member 58 when placed inside the recessed spaces 61, 62. Formed centrally in the transverse member 58 and between the battery recessed spaces 61, 62 is an upward extending LED bulb receiving neck 65. Also, formed between the two battery-recessed spaces 61, 62 and extending under the LED bulb-receiving neck 65 is a transversely aligned groove 66 designed to receive two wires 71, 72 that extend laterally in opposite directions from the LED bulb 70 when placed into the neck 65. During use, the batteries 63, 63' are inserted in opposite orientation in the recessed spaces 61, 62. When the lens 75, discussed further below, is disposed into the first cavity 54 and rotated, the lower surface of the lens 75 presses against the two batteries 63, 63' and forces them downward into the recessed spaces 61, 62 so that they make contact with the wires 71, 72 to complete the electrical circuit.

The lens 75 is circular and made of semi-flexible, transparent material. In the preferred embodiment, shown in FIGS. 12–15, two opposite oriented slots 77 are formed on the perimeter edge of the lens 75. The slots 77 engage two inward-extending tabs 55 formed on the base member's outer sidewall 53 shown in FIG. 11. The lens 75 includes an unobstructed center bulb cavity 78 through which the tip of the LED bulb 70 extends when the LED bulb 70 is placed into the holding neck 65 and the lens 75 is attached to the base member 52.

During assembly, the lens 75 is positioned over the first cavity 54 so that the two slots 77 engage the two tabs 55. Also formed along the perimeter edge of the lens 75 adjacent to the two slots 77 are two cam surfaces 79. When the lens 75 is placed on the base member 52 and is rotated to force the lens 75 against the cam surfaces 79, the lens 75 travels below the tabs 55 which forces the lens 75 downward and into the first cavity 54 and against the batteries 63, 63'. In the preferred embodiment, the lens 75 may be rotated over cam surfaces 79 so that one of three possible positions may be obtained: "assemble/disassemble" position, "off" position, and "on" position.

Attached on the bottom surface of the lens 75 is a U-shaped or semi-circular contact wire 80. The contact wire 80 is transversely aligned on the bottom surface of the lens 75 so that ends of the contact wire 80 touch the two top surfaces of the two batteries 63, 63' when the lens 75 is rotated and forced downward into the first cavity 54 to the "on" position. When rotated in the opposite direction, the lens 75 moves outward from the cavity 54 and spaced apart from the top surface of the batteries 63, 63'.

Formed on the bottom surface of the transverse member 58 are two parallel, upward extending arms 82 that pivotally connect to the two legs 83 on a U-shaped bail 85. The bail 85 is designed to pivot between retracted or extended positions from the traverse member 58. During use, the bail 85 enables the user to attach the flashlight assembly 50 to a hook or to support the flashlight assembly 50 in a diagonally aligned position on a horizontal surface.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A combination flashlight and candle lantern comprising :

a. a candle lantern including a lower base with an upper cavity and a lower cavity, a tube candle holding means connected to said upper cavity, a tube candle attached to said tube candle holding means, and an upper cover attached to said lower base and over said tube candle; and, b. a flashlight assembly that fits into said lower cavity on said lower base, said flashlight assembly including a base member, an illumination means, a stored electricity source, and a lens, said lens having a semi-circular conductor located on a surface adjacent to said stored electricity source that connects and disconnects said illumination means from said stored electricity source according to the rotational position of said lens.

2. The combination flashlight and candle lantern as recited in claim 1, wherein said illumination means is at least one LED bulb.

3. The combination flashlight and candle lantern as recited in claim 2, wherein said stored electricity source is at least one watch battery with sufficient voltage to activate said LED bulb.

4. The combination flashlight and candle lantern as recited in claim 1, further including means for holding said base member inside said lower cavity of said lower base.

5. The combination flashlight and candle lantern as recited in claim 3, further including a bail attached to said base member.

6. A combination flashlight and candle lantern, comprising:

a. a cylindrical lower base including an upper cavity and a lower cavity;

b. a tube candle holding means located in said upper cavity;

c. a tube candle attached to said tube candle holding means;

d. an upper cover attached to said lower base and over said tube candle, and, e. a flashlight assembly including a cylindrical base member that fits into said lower cavity on said lower base, said base member including first and second cavities separated by a transverse member, an illumination means attached to said transverse member, a stored electricity source disposed inside said second cavity attached to said transverse member, a lens disposed over said second cavity, said lens including a switch means to selectively control activation of said illumination means.

7. The combination flashlight and candle lantern, as recited in claim 6, wherein said stored electricity source is two flat watch batteries located on said transverse member.

8. The combination flashlight and candle lantern, as recited in claim 6, wherein said illumination means is at least one LED bulb longitudinally aligned and locked centrally on said transverse member.

9. The combination flashlight and candle lantern as recited in claim 8, further including a semi-circular conductor attached to a surface on said lens adjacent to said batteries and said LED bulb which connects and disconnects said batteries from said LED bulb when said lens is rotated.

10. The combination flashlight and candle lantern as recited in claim 8, wherein said lens includes at least two cam surfaces formed thereon that move said lens longitudinally towards or from said batteries.

11. An improved candle lantern that uses a lower base that supports a tube candle, an upper cover, and a lens, wherein the improvement comprises:

a. a lower cavity formed on said lower base:

b. a flashlight assembly disposed inside said lower cavity, said flashlight assembly including an illumination means, a stored electricity source connected to said illumination means, a lens, and a connector attached to said lens that selectively connects and disconnects said illumination means from said stored electricity source according to the rotational position of said lens.

12. The improved candle lantern, as recited in claim 11, wherein said stored electric source is a pair of watch batteries aligned adjacent to said lens so that said connector makes contact therewith.

13. The improved candle lantern, as recited in claim 12, wherein said connector is semi-circular in shape and said batteries are located on opposite sides of said center axis of said lens.

14. The improved candle lantern, as recited in claim 13, further including at least two cam surfaces formed on said lens that move said lens forward and away from said base as said lens is rotated thereby enabling said connector to make or break electrical contact with said batteries on said illumination means.

15. The improved candle lantern, as recited in claim 14, wherein said illumination means is a LED bulb.

16. The improved candle lantern, as recited in claim 15, wherein said LED bulb includes two lateral contact strips.

17. The improved candle lantern, as recited in claim 11, further including means for holding said flashlight inside said lower cavity.

* * * * *